US005950886A

United States Patent [19]

Maupin

[11] Patent Number: 5,950,886

[45] Date of Patent: Sep. 14, 1999

[54] CARRIER APPARATUS FOR CARRYING AN OBJECT

[76] Inventor: Matthew J. Maupin, 600 Wilbur Ave., #2012, Antioch, Calif. 94509

[21] Appl. No.: 09/144,739

[22] Filed: Sep. 1, 1998

[51] Int. Cl.[6] ..... A61G 1/00

[52] U.S. Cl. ..... 224/157; 224/158; 224/160; 224/262; 224/628; 224/660; 224/666

[58] Field of Search ..... 224/157, 160, 224/161, 628, 637, 677, 261, 907, 201, 627, 660, 666, 663, 184, 200, 646, 639, 640, 262, 263, 190, FOR 211, FOR 215; 297/183.6; 5/625

[56] References Cited

U.S. PATENT DOCUMENTS 551,512 12/1895 Schildhauer .
707,610 8/1902 Moeller .
1,317,234 9/1919 Stelnonis .
1,403,431 1/1922 McElhone .
1,535,208 4/1925 Drennan .
3,486,671 12/1969 Sanders .
3,659,760 5/1972 Blood .
4,298,149 11/1981 Gottschalk et al. ..... 224/201
5,181,638 1/1993 McHale ..... 224/215
5,466,040 11/1995 Fainsztein ..... 297/183.6
5,890,227 4/1999 Brown ..... 2/102

*Primary Examiner*—Stephen P. Garbe
*Assistant Examiner*—Maerena W. Brevard
*Attorney, Agent, or Firm*—Thomas R. Lampe

[57] ABSTRACT

Carrier apparatus for carrying an object includes a substantially rigid carrier member having recesses formed at the lower edges thereof for receiving the hips of an individual using the carrier apparatus. Weight of the carrier apparatus and any object carried by the carrier apparatus is supported by the individual's hips.

11 Claims, 4 Drawing Sheets

CARRIER APPARATUS FOR CARRYING AN OBJECT

TECHNICAL FIELD

This invention relates to carrier apparatus for carrying an object. The invention has particular application to the lifting and carrying of a stretcher or litter holding a person such as in emergency medical transport situation.

BACKGROUND OF THE INVENTION

Stretchers are commonly utilized to transport patients from the scene of an emergency to an ambulance as well as to and from other locations. Typical users of such equipment are emergency medical technicians, fire department members, search and rescue teams and paramedics.

Carrying a patient on a stretcher is normally a two person job, the individuals doing the carrying typically supporting the stretcher by their arms while maintaining the stretcher at waist level. This is done in an attempt to reduce strain on the carriers' backs and to maintain the weight closer to the center of gravity of their bodies. Despite this standard approach, back injuries are often incurred by emergency medical personnel during patient transport. Furthermore, maneuvering of the stretcher and patient in confined spaces can increase the chances of back, neck and shoulder injuries due to less than ideal weight displacement and body posture necessitated during the maneuvers.

Another problem is that a person carrying the stretcher and the patient can lose his or her balance and be forced to remove a hand from the stretcher in an attempt to correct the situation. Often, the only feasible option at this point is for the carrier to drop the patient since the stretcher and patient cannot be supported by only one hand. This problem is exacerbated if the patient has to be transported up or down stairs or if the medic or other carrier has to transport additional equipment on his or her person.

Carrying devices of various types are known in the prior art, including carrying devices specifically devised for the purpose of carrying stretchers or litters. In such arrangements the typical approach is to support most, if not all, of the patient's weight from the shoulders of the person or persons carrying the patient. Such an approach encourages back and other injuries.

The following United States patents are known and are believed to be representative of the state of the prior art in this field: U.S. Pat. No. 3,486,671, issued Dec. 30, 1969, U.S. Pat. No. 1,403,431, issued Jan. 10, 1922, U.S. Pat. No. 1,535,208, issued Apr. 28, 1925, U.S. Pat. No. 1,317,234, issued Sep. 30, 1919, U.S. Pat. No. 3,659,760, issued May 2, 1972, U.S. Pat. No. 551,512, issued Dec. 17, 1895, U.S. Pat. No. 5,466,040, issued Nov. 14, 1995, and U.S. Pat. No. 707,610, issued Aug. 26, 1902.

DISCLOSURE OF INVENTION

The present invention relates to carrier apparatus for carrying an object. The preferred form of apparatus disclosed herein is for the purpose of carrying or transporting a stretcher or litter having a patient thereon.

The apparatus is aimed at substantially reducing the risk of back or other injuries to medical personnel during the lifting and transport of a patient, particularly when the patient is being carried up or down inclined surfaces or in confined spaces. The apparatus will maintain the patient in an elevated position even if one or more of the persons carrying the patient is forced to remove one or more of his or her hands from the stretcher. This enables the medical workers to use their hands to attain or maintain stability or perform such necessary functions as opening doors during the carrying operation. Furthermore, the apparatus facilitates sideways tipping or other maneuvering of the stretcher and patient by the carrying parties during the transport operation as is sometimes necessary.

The carrier apparatus of the present invention includes a substantially rigid carrier member of unitary construction for placement about the waist of an individual.

The carrier member includes a carrier member front, a carrier member back and two opposed carrier member sides interconnecting the carrier member front and the carrier member back.

Each carrier member side has a bottom defining a recess for receiving the hip of an individual. In the preferred embodiment of the invention disclosed herein the bottoms are curved at the locations of the recesses. The bottoms of the carrier member sides are supported by the individual's hips when the hips are received by the recesses to provide support for the carrier member.

Securing means is provided for releasably securing the carrier member about the individual's waist.

The apparatus further includes an object engagement member connected to the carrier member front and extending outwardly from the carrier member front for engagement with an object, enabling the individual to carry the object with the carrier apparatus supported by the individual's hips.

Other features, advantages, and objects of the present invention will become apparent with reference to the following description and accompanying drawings.

BEST MODE FOR CARRYING OUT THE INVENTION

Figure 1:
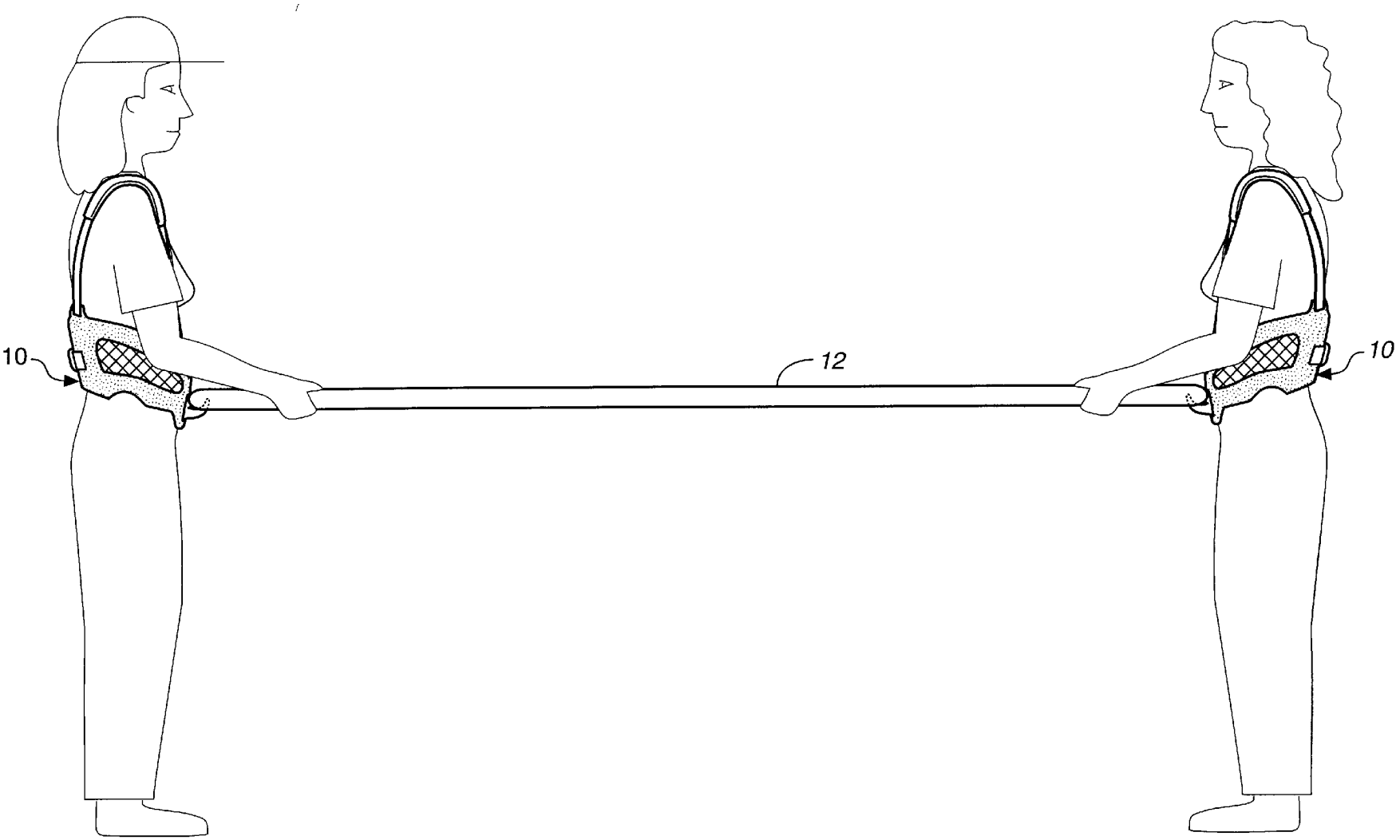
FIG. 1 is a front elevational view illustrating apparatus constructed in accordance with the teachings of the present invention being worn by two persons and utilized to support a stretcher extending between the two carriers.
Figure 2:
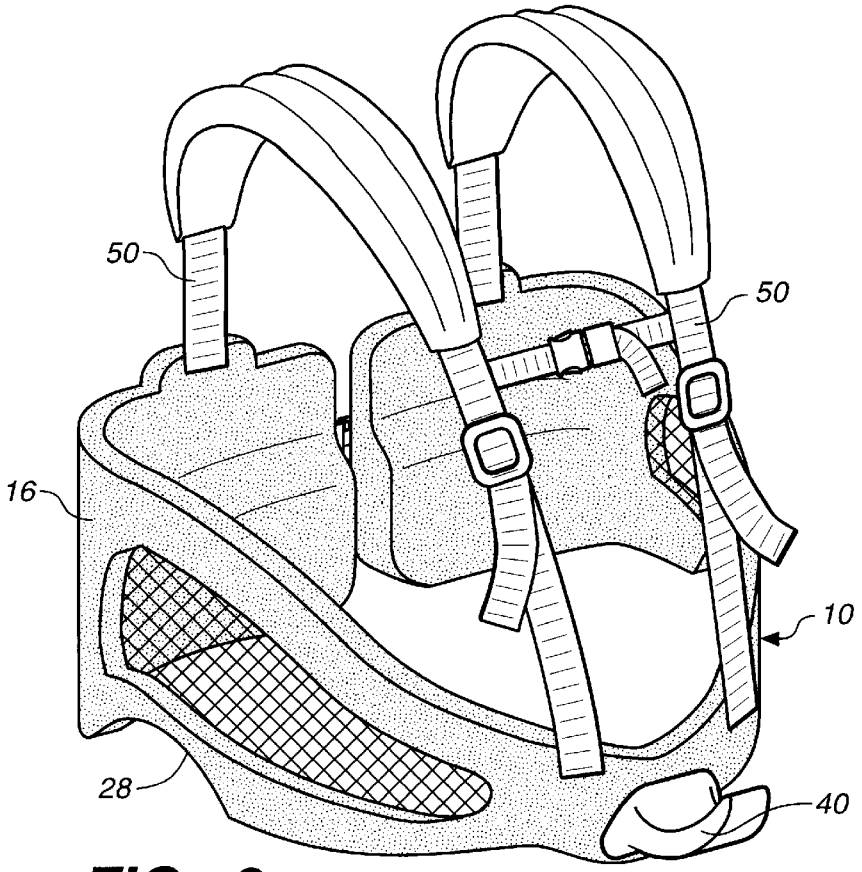
FIG. 2 is a front perspective view of the apparatus.

Referring now to the drawings, apparatus constructed in accordance with the teachings of the present invention is designated by reference numeral 10. FIG. 1 illustrates two persons wearing the apparatus and employing same to support stretcher 12 from the ends of the stretcher.

Apparatus 10 includes a carrier member 14 which is covered by a cover 16, the cover being formed of nylon fabric or any other suitable material.

Figure 8:
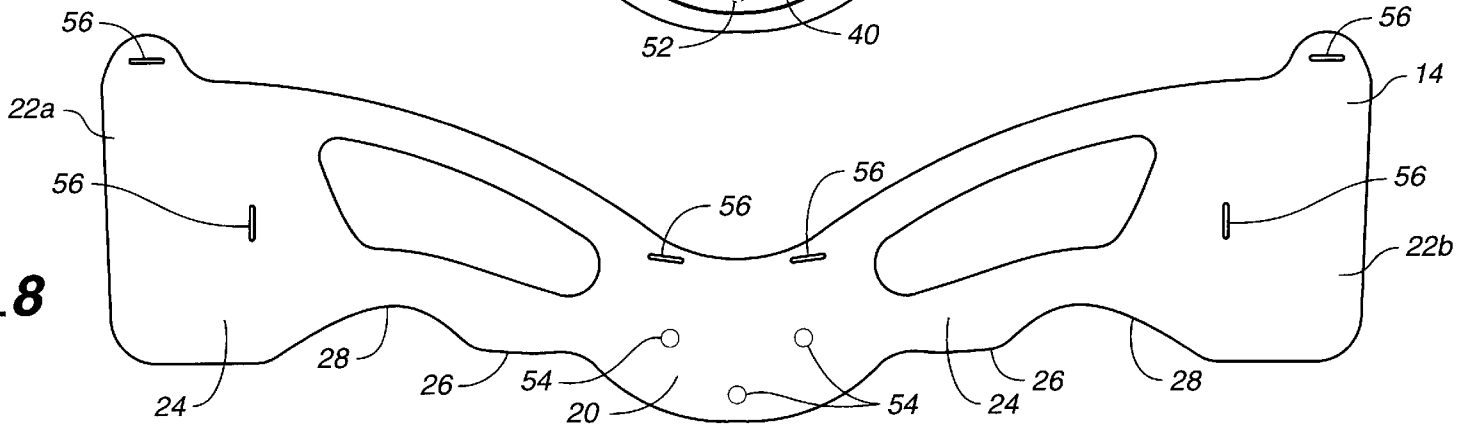
FIG. 8 is a frontal view of the carrier member of the apparatus disposed in a substantially planar configuration.

FIG. 8 provides an illustration of the carrier member 14 disposed in a substantially planar configuration. The carrier member 14 is constructed of material such as plastic (for example polyethylene) or metal, the material being of a substantially hard and unyielding character. While FIG. 8 shows the carrier member spread out along a plane, in use the carrier member is wrapped about the waist of the individual wearing the carrier apparatus, it being understood that the carrier member illustrated has sufficient flexibility for such purpose. However, the carrier member could also be preformed to a band-like configuration having just enough flexibility to allow the carrier apparatus to be maneuvered into position on the individual using same. Carrier member 14 includes a carrier member front 20, a carrier member back 22 (comprised of the two back portions 22*a* and 22*b*) and two opposed carrier member sides 24 interconnecting the carrier member front and the carrier member back.

Each carrier member side has a lower end 26 which is curved to define a recess 28. The recesses 28 are for receiving the hips of the individual wearing the apparatus. The lower ends of the carrier member sides are supported by the individual's hips when the hips are received by the recesses to provide support for the rigid carrier member.

Figure 7:
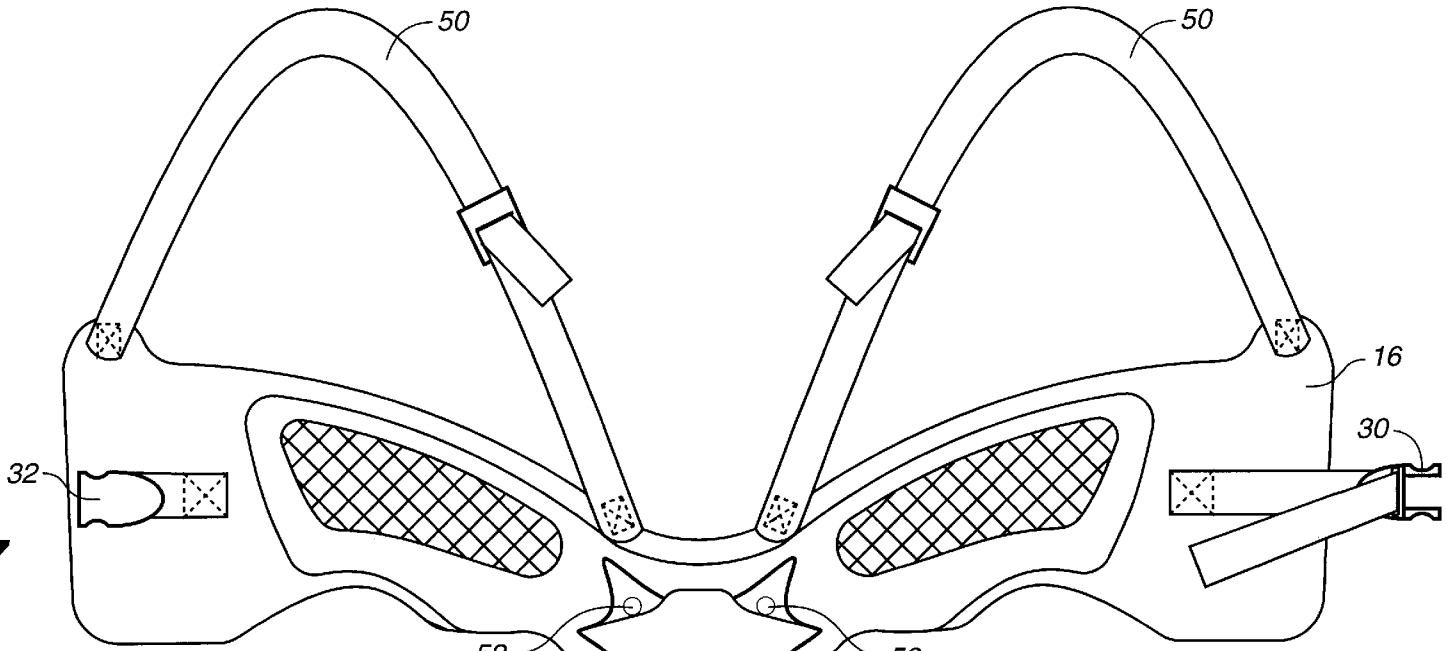
FIG. 7 is a frontal view of the apparatus disposed in a substantially planar configuration.

Securing means in the form of releasably connectable latch members 30, 32 are employed to releasably secure the carrier member about the individual's waist as a rigid structure. In the arrangement illustrated, the latch members 30, 32 are located on straps sewn to cover 16 and preferably also attached to the carrier member. Latch members 30, 32 may be of any suitable conventional type and at least one of the latch members is adjustably positionable on its associated strap. FIG. 7 illustrates latch member 30 as being adjustable relative to the strap to which it is connected.

An important component of the apparatus is an object engagement member, which in the preferred embodiment disclosed herein comprises a hook 40 which is centered with respect to carrier member front 20 and projects outwardly therefrom in a manner illustrated in the drawing figures. Hook 40 may be formed of any suitable material such as metal or plastic. The form of the hook 40 illustrated is of integral construction; however, it is to be understood that other types of object engagement members such as retractable hooks or hooks with related latches to lock the hook to a stretcher may be utilized. One wishing to transport a stretcher utilizing hook 40 merely places a stretcher end in the concavity of the hook (as illustrated in FIG. 1 for example). The hook operates as a fulcrum about which the stretcher may be tilted sideways by the carriers to maneuver the stretcher through tight quarters.

Figure 6:
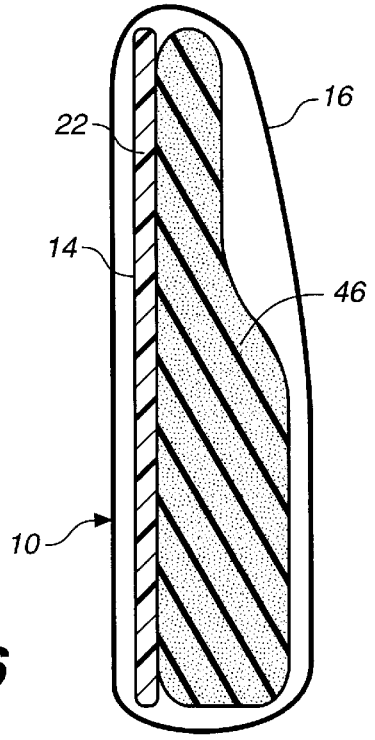
FIG. 6 is a greatly enlarged cross-sectional view of the back of the apparatus as taken along the line 6—6 in FIG. 4.
Figure 5:
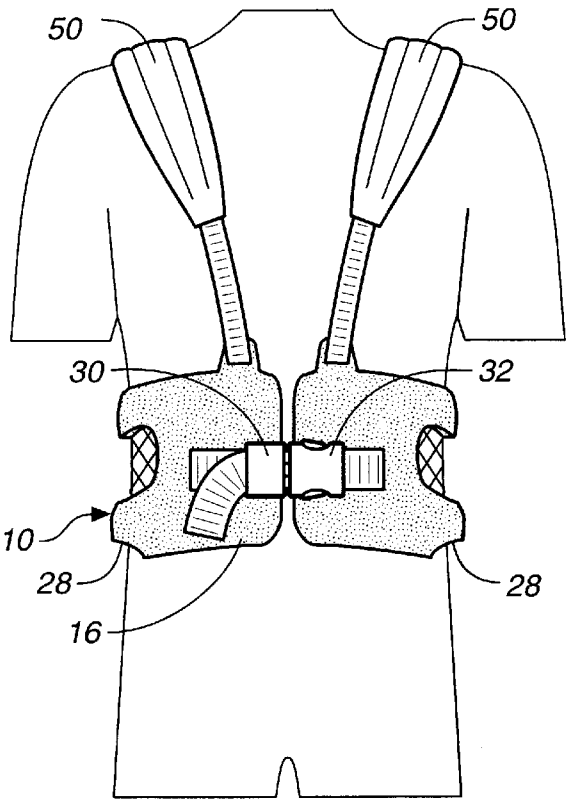
FIG. 5 is a rear elevational view of the apparatus as positioned on a person.
Figure 4:
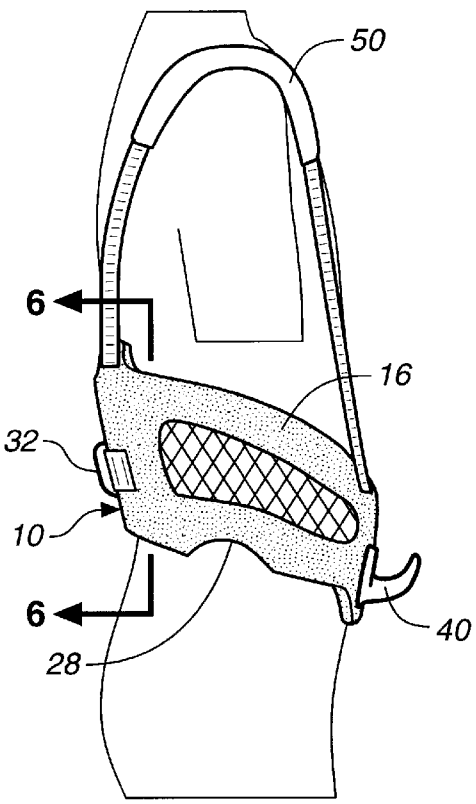
FIG. 4 is a left elevational view of the apparatus as positioned on a person.
Figure 3:
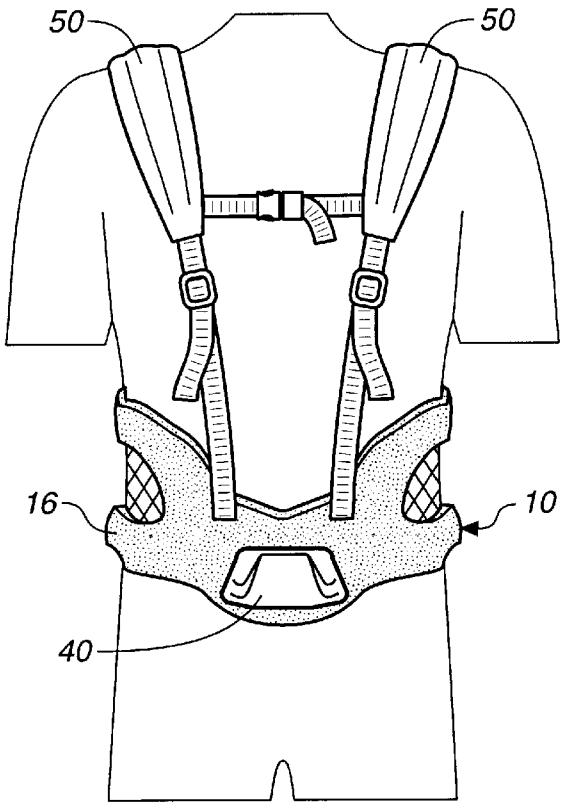
FIG. 3 is a front view of the apparatus as positioned on a person.

The carrier member back 22 extends upwardly above the level of the hook when the carrier apparatus is being worn. The carrier member back covers and engages a substantial portion of the back of the individual using the apparatus to resist forward tilting of the rigid carrier member and the rest of the apparatus about the user's hips. In this connection (see FIG. 6) padding 46 is deployed between carrier member 14 and the individual's back at the location of the carrier member back. If desired, padding can be employed along the entire inwardly directed surface of rigid carrier member 14.

Adjustable shoulder straps 50 are connected to cover 16 and preferably also attached to carrier member 14 in the fully assembled apparatus to be positioned over the shoulders of the individual employing the apparatus. The shoulder straps provide stability to the apparatus and may also serve to provide a certain amount of support therefor and for a stretcher and patient held by the apparatus, but an important aspect of the present apparatus resides in the fact that the hips of the individual wearing the apparatus provide a high percentage of that support.

When the weight of a patient and stretcher is applied to the front of the apparatus through hook 40 some downward movement of the front of the apparatus would be expected, the hips of the individual employing the apparatus essentially acting as fulcrums for the rigid carrier member and the rest of the apparatus. Downward movement of the front of the apparatus would result in some degree of tilting of the apparatus in a forward direction. This is countered and limited by the relatively high carrier member back and counter forces applied thereto along the entire area of contact between the back of the apparatus and the back of the person wearing same. This distribution of forces lessons the chances of back injury. To perform this function, the carrier member back should preferably be at least six inches from its top to its bottom.

The hook 40 may be secured in place in any desired fashion but such securement should be had with the rigid carrier member and not just with the cover. One suitable approach would be to employ mechanical fasteners, such as rivets, to secure the hook directly to the carrier member 14 through cover 16. FIG. 7 shows rivets 52 extending through the hook, cover and carrier member. FIG. 8 shows the corresponding locations of the holes for the rivets in the carrier member 14, such holes being designated by reference numeral 54. Carrier member 14 also has slots 56 formed therein which may, be utilized to directly secure to the carrier member the ends of shoulder straps 50 and the straps associated with latch members 30, 32.

I claim:

1. Carrier apparatus for carrying an object, said carrier apparatus comprising, in combination:

a substantially rigid carrier member of unitary construction for placement about the waist of an individual, said carrier member including a carrier member front, a carrier member back and two opposed carrier member sides interconnecting said carrier member front and said carrier member back, each said carrier member side having a lower end defining a recess for receiving the hips of the individual, said lower ends of said carrier member sides being supported by the individual's hips when the hips are received by said recesses to provide support for said carrier member;

securing means for releasably securing said carrier member about the individual's waist; and an object engagement member connected to the carrier member front and extending outwardly from said carrier member front for engagement with an object, enabling the individual to carry the object with the carrier apparatus supported by the individual's hips.

2. The carrier apparatus according to claim 1 wherein said carrier member back extends upwardly above the level of said object engagement member and covers and engages a substantial portion of the individual's back to resist tilting of said carrier apparatus about the individual's hips.

3. The carrier apparatus according to claim 1 additionally comprising shoulder supports connected to said carrier member and extending upwardly therefrom for passage over the shoulders of the individual.

4. The carrier apparatus according to claim 1 wherein said carrier member is of integral construction and has a band-like configuration and two ends, said securing means releasably securing together said two ends.

5. The carrier apparatus according to claim 1 additionally comprising padding located between said carrier member and the individual.

6. The carrier apparatus according to claim 1 additionally comprising a cover substantially covering said carrier member.

7. The carrier apparatus according to claim 1 wherein said object engagement member comprises a hook substantially centrally disposed relative to said carrier member front.

8. The carrier apparatus according to claim 4 wherein said carrier member is of integral molded plastic construction.

9. The carrier apparatus according to claim 1 wherein said carrier member back is at least six inches from top to bottom thereof.

10. The carrier apparatus according to claim 4 wherein said securing means is adjustable to vary the tightness of said carrier member about the individual's body.

11. The carrier apparatus according to claim 1 wherein lower ends of said carrier member sides are curved at the locations of said recesses.

* * * * *